US010570580B2

(12) United States Patent
Coudry et al.

(10) Patent No.: US 10,570,580 B2
(45) Date of Patent: Feb. 25, 2020

(54) EXCAVATION SYSTEM WITH INTERCHANGEABLE TOOLS

(71) Applicant: SOLETANCHE FREYSSINET, Rueil Malmaison (FR)

(72) Inventors: Michel Coudry, Rueil Malmaison (FR); Pascal Rodriguez, Rueil Malmaison (FR); Serge Borel, Rueil Malmaison (FR); Daniel Perpezat, Rueil Malmaison (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 203 days.

(21) Appl. No.: 15/749,808

(22) PCT Filed: Aug. 4, 2016

(86) PCT No.: PCT/FR2016/052034
§ 371 (c)(1),
(2) Date: Feb. 2, 2018

(87) PCT Pub. No.: WO2017/021664
PCT Pub. Date: Feb. 19, 2017

(65) Prior Publication Data

US 2018/0230667 A1 Aug. 16, 2018

(30) Foreign Application Priority Data

Aug. 5, 2015 (FR) ..... 15 57549

(51) Int. Cl.
*E02F 3/24* (2006.01)
*E02F 3/36* (2006.01)
(Continued)

(52) U.S. Cl.
CPC ..... *E02F 3/246* (2013.01); *E02D 17/13* (2013.01); *E02F 3/205* (2013.01); *E02F 3/3654* (2013.01);
(Continued)

(58) Field of Classification Search
CPC ..... E02F 3/246; E02F 3/205; E02F 3/3654; E02F 3/3677; E02F 3/9218; E02F 3/96; E02F 5/305; E02D 17/13; B02C 2019/183
See application file for complete search history.

(56) References Cited

U.S. PATENT DOCUMENTS 6,193,444 B1 2/2001 Jonninen
7,114,271 B2 * 10/2006 Chagnot ..... E02F 3/205 37/352
(Continued)

FOREIGN PATENT DOCUMENTS

DE 10361337 A1 7/2005
EP 0921270 A1 6/1999
(Continued)

*Primary Examiner* — Jamie L McGowan
(74) *Attorney, Agent, or Firm* — MH2 Technology Law Group, LLP

(57) ABSTRACT

The invention relates to the field of excavation systems, and more particularly to excavation systems including tools for excavation by electric pulses. An excavation system of the invention comprises a support frame (34), a hydraulic circuit with a pump, and first and second excavation tools. One of said first and second excavation tools is a mechanical excavation tool (1') having a hydraulic actuator and a mounting interface with at least one mechanical fastener member and at least one hydraulic coupling in fluid flow communication with said hydraulic actuator, while the other one of said first and second excavation tools is a tool (1) for excavation by electric pulses, comprising an electricity
(Continued)

generator (3) with a rotary shaft for generating electricity from rotation of the rotary shaft, a hydraulic motor coupled to said rotary shaft to drive rotation of the rotary shaft, and an electronic power module (4) electrically connected to the electricity generator (3) in order to be powered by the electricity generator (3) so as to generate electric pulses of instantaneous power that is higher than an instantaneous power of the electricity generator (3), a plurality of electrodes (5*a*, 5*p*) including at least one electrode (5*a*) connected to said electronic power module (4), the electrodes being arranged on said front face, and a mounting interface (14) with at least one mechanical fastener member (22), and at least one hydraulic coupling (20) in fluid flow communication with said hydraulic motor (2). Each of the mounting interfaces of the first and second excavation tools is suitable for releasably mounting the corresponding excavation tool in alternation under the support frame (34) of the excavation system, with the corresponding hydraulic coupling in fluid flow communication with said hydraulic circuit of the excavation assembly.

15 Claims, 7 Drawing Sheets

(51) Int. Cl.

| | |
|---|---|
| ***E02F 3/92*** | (2006.01) |
| ***E02F 3/96*** | (2006.01) |
| ***E02F 5/30*** | (2006.01) |
| ***E02D 17/13*** | (2006.01) |
| ***E02F 3/20*** | (2006.01) |
| *B02C 19/18* | (2006.01) |

(52) U.S. Cl.
CPC ..... *E02F 3/3677* (2013.01); *E02F 3/9218* (2013.01); *E02F 3/96* (2013.01); *E02F 5/305* (2013.01); *B02C 2019/183* (2013.01)

(56) References Cited

U.S. PATENT DOCUMENTS

| | | | | |
|---|---|---|---|---|
| 8,020,323 | B2 * | 9/2011 | Chagnot | E02D 5/18 37/189 |
| 2005/0000122 | A1 | 1/2005 | Chagnot et al. | |
| 2013/0185966 | A1 * | 7/2013 | Harrington | E02F 5/00 37/466 |
| 2014/0020268 | A1 * | 1/2014 | Buckner | E02F 3/8891 37/304 |
| 2014/0130382 | A1 * | 5/2014 | Harrington | F41H 11/12 37/195 |

FOREIGN PATENT DOCUMENTS

| | | | |
|---|---|---|---|
| EP | 1486620 | A1 | 12/2004 |
| JP | H11141270 | A | 5/1999 |

* cited by examiner

EXCAVATION SYSTEM WITH INTERCHANGEABLE TOOLS

BACKGROUND OF THE INVENTION

The present invention relates to the field of excavation systems, and particularly to the field of excavation systems including tools for excavation by electric pulses.

Among existing excavation tools, there are known in particular excavation tools of the cutter type in which a rotary cutter head, or "cutter", breaks up the ground in order subsequently to allow the spoil that is obtained in that way to be removed. Cutter type excavation tools are usually used to make trenches in the ground to relatively great depth, up to 200 meters (m), and of thickness that is relatively small compared with said depth, the thickness typically lying in the range 500 millimeters (mm) to 1800 mm. A typical width for the tooling is 2800 mm. One of the advantages of such machines is that they enable such trenches of great depth to be made while complying with rigorous verticality criteria, in particular in order to ensure good continuity between adjacent panels. The trench as a whole is obtained by digging successive panels that are adjacent and juxtaposed.

Nevertheless, a drawback of such excavation tools is that they are not very effective when excavating layers of ground that are particularly hard, and in particular layers of rock. In order to solve this problem, tools have been proposed that excavate by electric pulses, e.g. in published patent applications US 2003/0137182 and EP 1 474 587. Such excavation tools typically include electrodes arranged on a front face of the excavation tool. High-power electric discharges between the electrodes can break up the rock situated directly under the front face in a manner that requires less energy than using a cutter.

Nevertheless, electrically powering the electrodes raises other problems. Even when the tool for excavation by electric pulses also includes an electronic power module for producing discharges of high power but of short duration from an electrical power supply continuously delivering nominal power that is more modest, the power supplied is nevertheless sufficiently high to raise problems of safety for equipment and personnel in the event of the power supply cable breaking in the proximity of the surface.

In order to solve that problem, drilling tools are known, in the specific field of drilling by electric pulses, that include generators driven hydraulically from the surface, e.g. the tools disclosed in published patent applications GB 2 420 358 and US 2010/0000790, and in utility model DE 20 2006 018 980 U1. Nevertheless, although such tools for drilling by electric pulses are well adapted to layers of hard rock, they are less well adapted to excavating layers of softer ground.

OBJECT AND SUMMARY OF THE INVENTION

The present disclosure seeks to remedy those drawbacks by proposing an excavation system that is versatile and effective, and that can easily be adapted to excavate in the most effective manner through layers of ground presenting compositions and consistencies that are very different. The system may comprise a support frame, a hydraulic circuit with a pump, and first and second excavation tools, one of said first and second excavation tools being a mechanical excavation tool having a hydraulic actuator and a mounting interface with at least one mechanical fastener member and at least one hydraulic coupling in fluid flow communication with said hydraulic actuator.

This object may be achieved by the fact that the other one of said first and second excavation tools is a tool for excavation by electric pulses, comprising an electricity generator with a rotary shaft for generating electricity from rotation of the rotary shaft, a hydraulic motor coupled to said rotary shaft to drive rotation of the rotary shaft, and an electronic power module electrically connected to the electricity generator in order to be powered by the electricity generator so as to generate electric pulses of instantaneous power that is higher than an instantaneous power of the electricity generator, a plurality of electrodes including at least one electrode connected to said electronic power module, the electrodes being arranged on said front face, and a mounting interface with at least one mechanical fastener member and at least one hydraulic coupling in fluid flow communication with said hydraulic motor, and each of the mounting interfaces of the first and second excavation tools is suitable for releasably and alternatively mounting the corresponding excavation tool under the support frame of the excavation system, with the corresponding hydraulic coupling in fluid flow communication with said hydraulic circuit of the excavation assembly.

By means of these provisions, the excavation system can easily be adapted to excavating different types of ground, with it being possible for the energy needed for operating the appropriate excavation tool always to be transmitted hydraulically from the surface, in a manner that is safer than transmitting electricity.

In the tool for excavation by electric pulses, the plurality of electrodes may in particular comprise a row of a plurality of electrodes arranged at the periphery of the front face of the drilling tool, so as to create an active excavation front at that periphery of the front face, thereby making it easier to break up the ground material under the front face.

Furthermore, the plurality of electrodes may also include at least one electrode arranged in a central zone of the front face, so as to act as a ridge-breaker.

The electronic power module may be suitable for producing electric pulses having a voltage of at least 50 kilovolts (kV), a current of at least 1 kiloamp (kA), and/or a duration of at least 30 nanoseconds (ns), and/or with a repetition frequency of at least 1 hertz (Hz). The plurality of electrodes may in particular comprise at least two electrodes connected to the electronic power module, and the electronic power module may be configured to transmit electric pulses separately to each of the at least two electrodes to which the electronic power module is connected, thus making it possible to obtain a phase shift between the pulses transmitted to each of the electrodes so as to increase the effectiveness of the excavation and/or so as to tilt the excavation front without tilting the tool.

In order to adapt the shape of the excavation front, the excavation tool may nevertheless also comprise an actuator device for driving movement of at least one electrode of said plurality of electrodes. In particular, this movement may include at least a vertical component and/or a horizontal component. Said actuator device may comprise at least one linear actuator.

In order to enable the broken up material to be removed from under its front face, the tool for excavation by electric pulses may further include at least one spoil-removal inlet.

Furthermore, in order to facilitate this spoil removal, the tool for excavation by electric pulses may also further comprise a fluid feed duct leading to at least one fluid injection nozzle arranged on a front face of the excavation tool. In this way, on being sucked into the spoil removal inlet, the fluid that is thus injected under the front face of the tool for excavation by electric pulses can entrain therewith the spoil in a manner that is particularly effective. To better distribute this fluid under the front face of the excavation tool, the fluid feed duct may lead to a plurality of fluid injection nozzles distributed over the front face of the tool for excavation by electric pulses. Furthermore, the fluid feed duct may in particular be suitable for feeding the at least one feed nozzle with liquid, and in particular with drilling mud, so as to entrain the spoil with the liquid, however, it may alternatively be suitable for feeding the at least one injection nozzle with gas, in particular compressed air, so as to entrain the spoil with the gas.

In order to facilitate excavating trenches, said front face may be elongate, e.g. rectangular, perpendicularly to an excavation direction.

The hydraulic coupling and one and/or the other of the excavation tools may in particular include at least one passage for the arrival of hydraulic liquid and at least one passage for the return of hydraulic liquid, although it is also possible to envisage omitting the return passage, e.g. if the fluid used as hydraulic fluid is a liquid that can subsequently be injected under the front face of the excavation tool in order to facilitate removal of spoil.

In order to enable the excavation front to be tilted, the support frame may include a device for tilting the excavation tool about at least one axis. In order to facilitate removal of spoil under the front face of the excavation tool, the excavation assembly may also include a spoil suction pump that may be situated in the excavation tool or else in the support frame, for example. If the excavation tool presents a spoil removal inlet, the spoil suction pump may be placed in fluid flow communication with the spoil removal inlet, downstream therefrom, so as to suck in spoil through the spoil removal inlet. Also, the spoil suction pump may be hydraulically actuated, for example. Thus, a single hydraulic circuit may be used for actuating the electricity generator and for actuating the spoil suction pump.

In order to facilitate lowering the evacuation tool into a well or a trench that is being excavated, the excavation assembly may include a jib from which the support frame is suspended by at least one cable.

The mechanical excavation tool may in particular be a cutter type excavation tool comprising a cutter member coupled to the hydraulic actuator of the mechanical excavation tool in order to be actuated.

This disclosure also provides a method of using such an excavation system for excavating a trench, the method comprising the following steps:

- mounting the first excavation tool under the support frame;
- excavating a first layer of ground with the first excavation tool;
- replacing the first excavation tool under the support frame with the second excavation tool; and
- excavating a second layer of ground with the second excavation tool.

BRIEF DESCRIPTION OF THE DRAWINGS

The invention can be well understood and its advantages appear better on reading the following detailed description of an embodiment shown as a nonlimiting example. The description refers to the accompanying drawings, in which.

DETAILED DESCRIPTION OF THE INVENTION

Figure 1A:
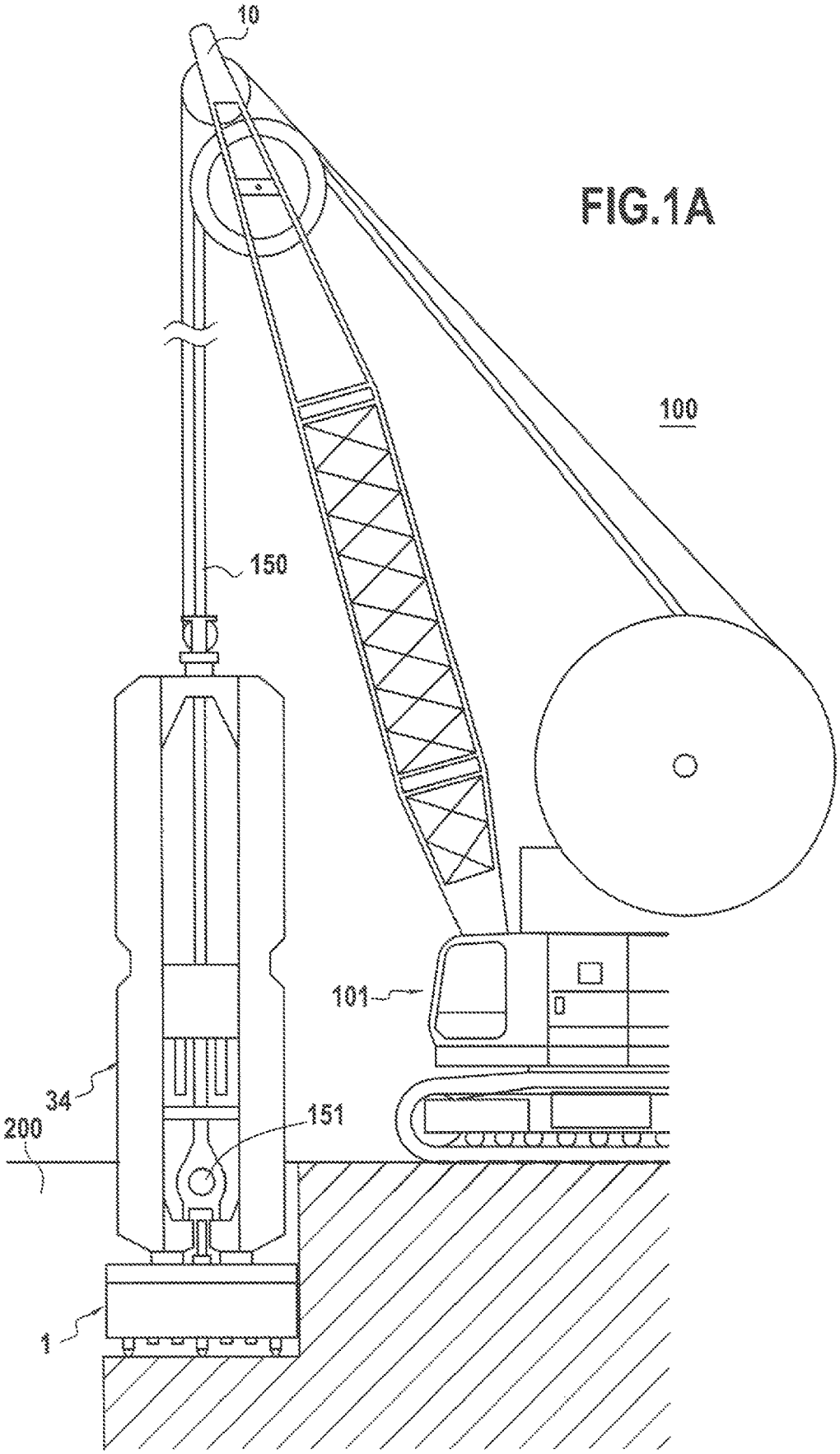
FIGS. 1A and 1B are diagrammatic views of an excavation system using two alternative excavation tools while excavating a trench.
Figure 1B:
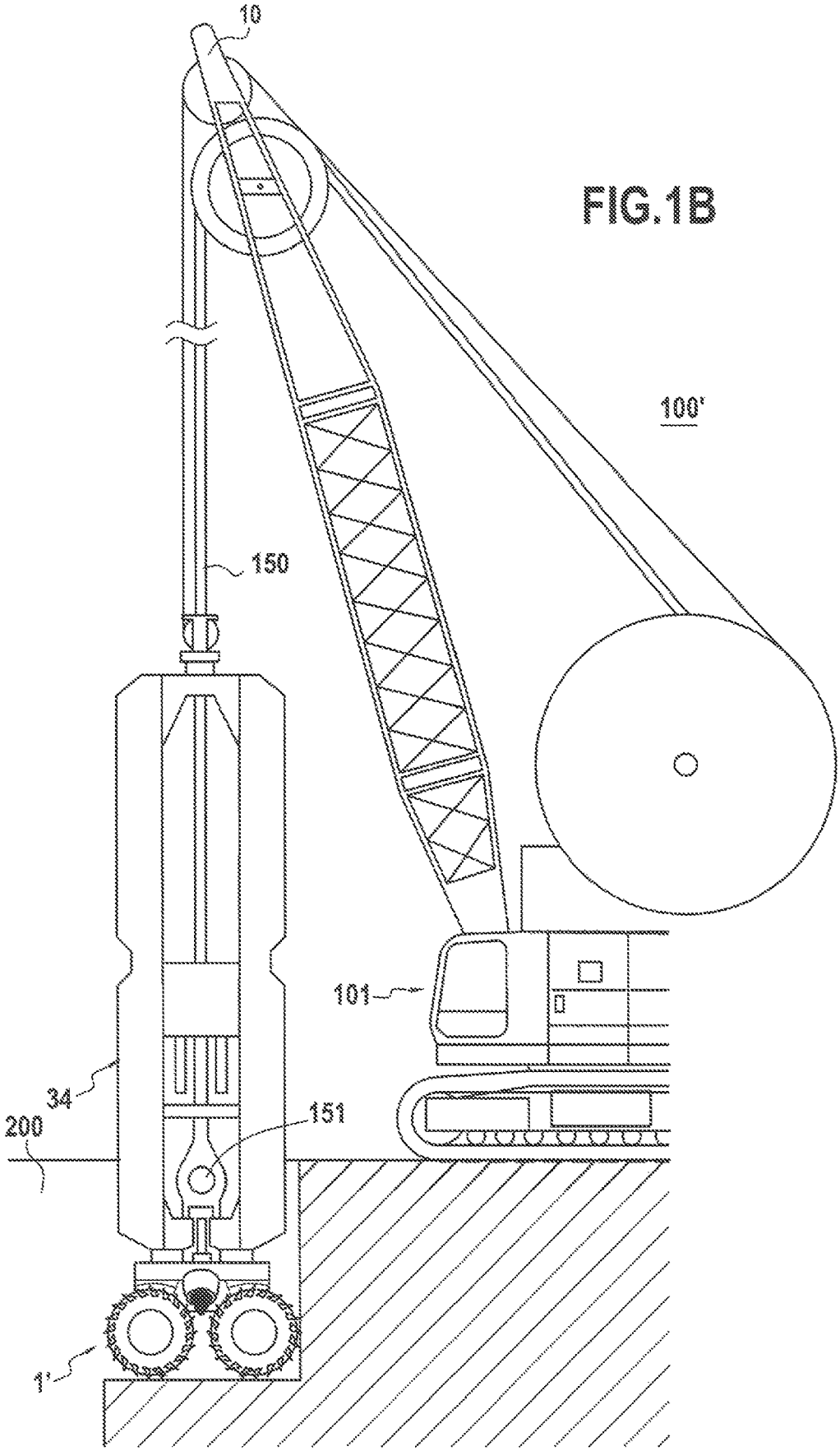

FIGS. 1A to 1B show an excavation system in an embodiment while excavating a trench 200 of depth P. The system comprises a jib 10, suitable for being installed on a movable base 101 that is movable over the surface of the ground that is to be excavated, a support frame 34 suspended from the jib 10 by at least one cable so as to be capable of being lowered into the trench and raised therefrom by actuating the cable, and excavation tools 1, 1' suitable for being suspended as alternatives under the support frame 34. The excavation tool 1 is a tool for excavation by electric pulses, while the excavation tool 1' is a mechanical excavation tool of the cutter type. The system also includes a hydraulic pump (not shown), that may be installed on the same movable base 101 supporting the jib 10, and that is connected to the support frame 34 and to the tool 1 for excavation by electric pulses by a hydraulic circuit (not shown), together with a circuit for feeding spoil-removal fluid (not shown), and a spoil-removal circuit 150. The circuit for feeding spoil-removal fluid is configured to supply a fluid that serves to entrain the solid spoil resulting from breaking up rocky material under the tool 1 or 1', so as to facilitate removal of the spoil via the spoil-removal circuit. The fluid may be a liquid, such as a drilling mud, or alternatively a gas, and in particular compressed air.

Furthermore, the support frame 34, which is configured so as to be guided against the side walls of the trench 200, presents in the vertical or excavation direction a height H that is relatively large in comparison with the width L and the thickness E of the support frame 34 and of the tool 1 in directions that are perpendicular to the height direction. The support frame 34 thus serves to guide the tool mechanically progressively while the trench 200 is being made so as to ensure that it is properly vertical, even when its depth P is large. By way of example, this depth P may be as much as 200 m.

In a first configuration, as shown in FIG. 1A, the tool 1 for excavation by electric pulses is releasably mounted under the support frame 1 to enable a hard rocky layer to be excavated, thus forming an assembly 100 together with the movable base 101, the jib 10, and the support frame 34, whereas in a second configuration, as shown in FIG. 1B, the tool 1 for excavation by electric pulses is replaced under the support frame 34 by a mechanical excavation tool 1' of the cutter type, thereby forming an alternative assembly 100' for excavating layers that are not so hard.

Figure 2:
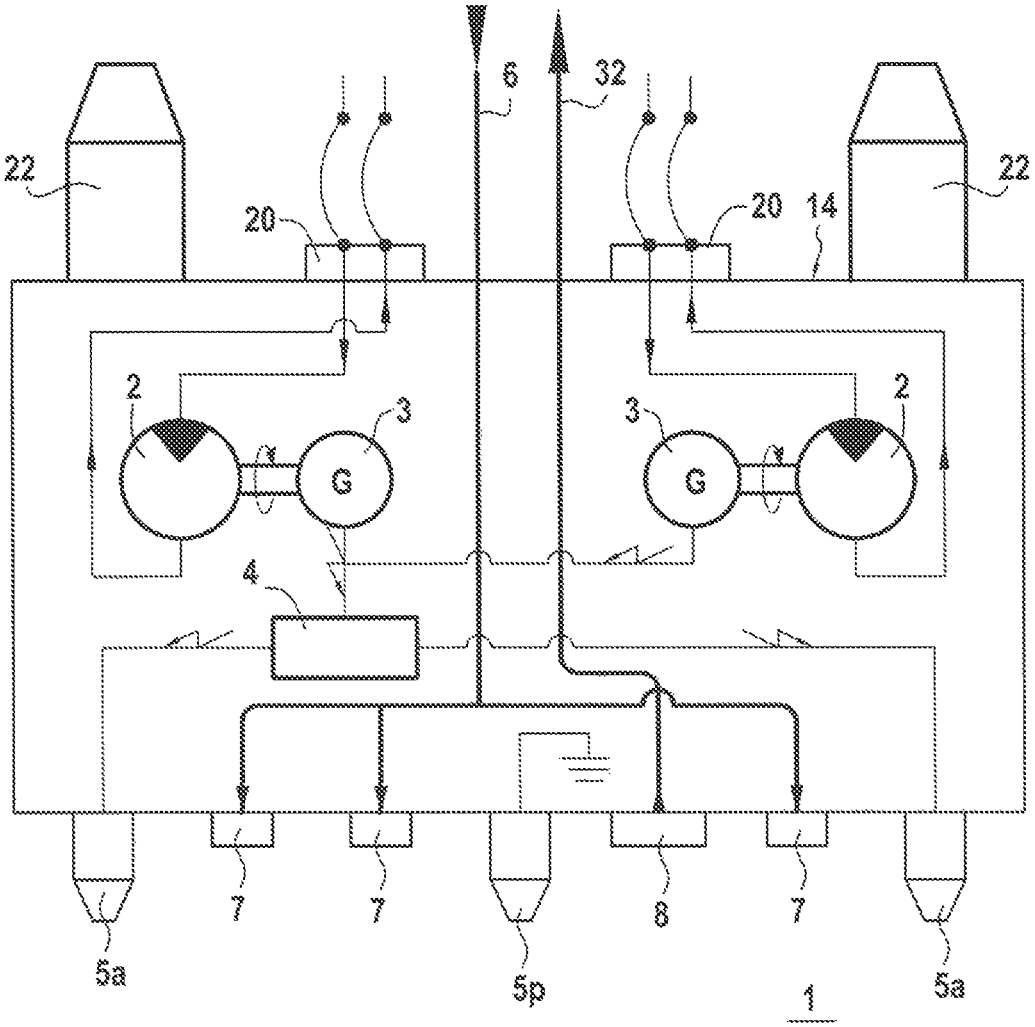
FIG. 2 is a diagrammatic view of a FIG. 1A tool for excavation by electric pulses.

The tool 1 for excavation by electric pulses is shown diagrammatically in FIG. 2. In the embodiment shown, it comprises two hydraulic motors 2, two electricity generators 3, an electronic power module 4, and a plurality of electrodes 5*a*, 5*p*. Furthermore, it also comprises an assembly interface 14 with two mechanical fastener members 22 in the form of studs, and two hydraulic couplings 20, each comprising at least one passage for delivering hydraulic fluid to the hydraulic motors 2, and at least one passage for returning hydraulic fluid from the hydraulic motors 2 so as to set up a fluid flow connection between the hydraulic circuit of the excavation assembly 100 and the hydraulic motors 2. Each hydraulic motor 2 may have continuous output power $P_h$ of up to 115 (kW), for example, and is mechanically coupled to a rotary shaft of a respective electricity generator 3 in order to generate electrical power $P_e=k\cdot P_h$, where k is an efficiency coefficient of the electricity generators and less than 1. Thus, by way of example, with a mechanical power $P_h$ of up to 115 kW for each hydraulic motor 2, it is possible to obtain electrical power $P_e$ of up to 100 kilovolt-amps (kVA) from each electricity generator 3. Both electricity generators are electrically connected to the electronic power module 4 so as to power it with continuous electrical power $P_c=n\cdot P_e$, where n is the number of electricity generators 3 (so n is thus equal to 2 in the embodiment shown).

Making use of the continuous electrical power $P_c$ supplied by the electricity generators 3, the electronic power module 4 is configured to generate electric pulses of instantaneous power $P_i$ that is substantially higher, but of short duration. Thus, the electric pulses generated by the electronic power module 4 may have a voltage V lying in the range 50 kV to 500 kV, for example, a current lying in the range 1 kA to 100 kA, for example, and a duration d lying in the range 30 ns to 100 microseconds (μs), for example, repeating a repetition frequency f lying in the range 1 Hz to 100 Hz, for example.

In the embodiment shown, the electronic power module 4 is electrically connected to two active electrodes 5*a* from among the three electrodes shown, so as to transmit the electric pulses thereto. The third electrode 5*p*, shown in the middle, is grounded, so that when the electric pulses are transmitted to the other two electrodes 5*a*, electric discharges are produced between these active electrodes 5*a* and the passive electrode 5*p* situated between them. These electrodes 5*a*, 5*p* are situated on a front face of the tool 1 for excavation by electric pulses so as to make contact with the rock face so that the electric discharges between the electrodes 5 pass through the rock and break it up. Naturally, the term "front face" is used to designate the face that faces the rock surface in the excavation direction, i.e. the face that normally faces downwards.

Figure 3A:
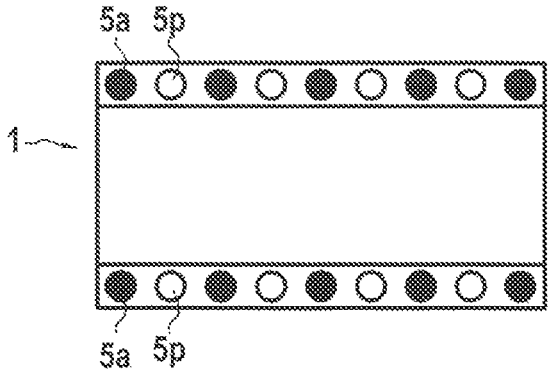
FIG. 3A the two 3D are diagrams showing several potential variant configurations for the FIG. 2 tool for excavation by electric pulses.
Figure 3B:
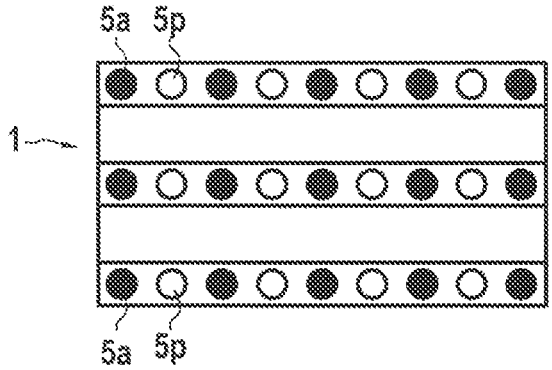
Figure 3C:
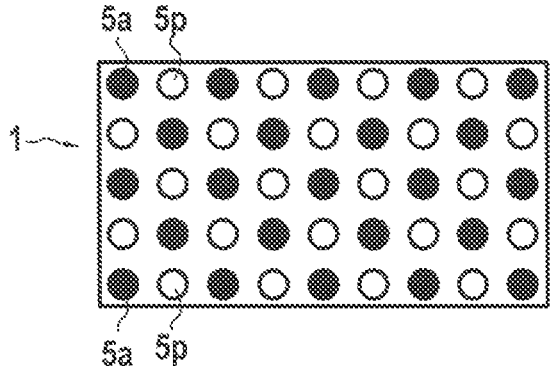
Figure 3D:
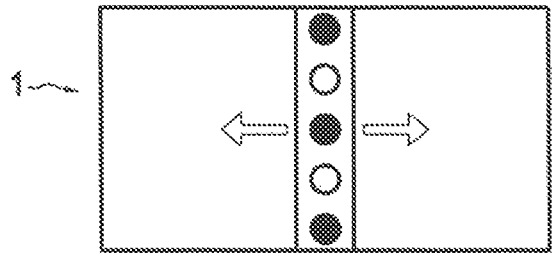

Although FIG. 2 shows only two active electrodes 5*a* and one passive electrode 5*p* between the two active electrodes 5*a*, the number and the arrangement of the electrodes on the front face of the tool for excavation by electric pulses may vary depending on circumstances, e.g. with a spacing between adjacent electrodes lying in the range 2 centimeters (cm) to 10 cm. Thus, in the variant shown in FIG. 3A, two rows of alternating active and passive electrodes 5*a* and 5*p* are situated on opposite sides of the periphery of the front face of the tool 1 for excavation by electric pulses, whereas the variant shown in FIG. 3B also has a third row of alternating active and passive electrodes 5*a* and 5*p* extending parallel to the other two rows and situated in a central zone of the front face of the tool 1 for excavation by electric pulses, so as to act as a ridge-breaker. In this context, the term "ridge" is used to mean the rocky crest that can form for example between two rotary drums of a cutter tool of the kind disclosed in EP 1 486 620. In a third variant, as shown in FIG. 3C, the active and passive electrodes are in a staggered configuration over the entire front face of the tool 1 for excavation by electric pulses, whereas in a fourth variant shown in FIG. 3D, the tool 1 for excavation by electric pulses also has a device for driving the electrodes 5*a*, 5*p* in horizontal movement so as to cover the entire surface of the front face of the tool 1 for excavation by electric pulses by moving a single linear row of electrodes 5*a*, 5*p*.

Figure 4:
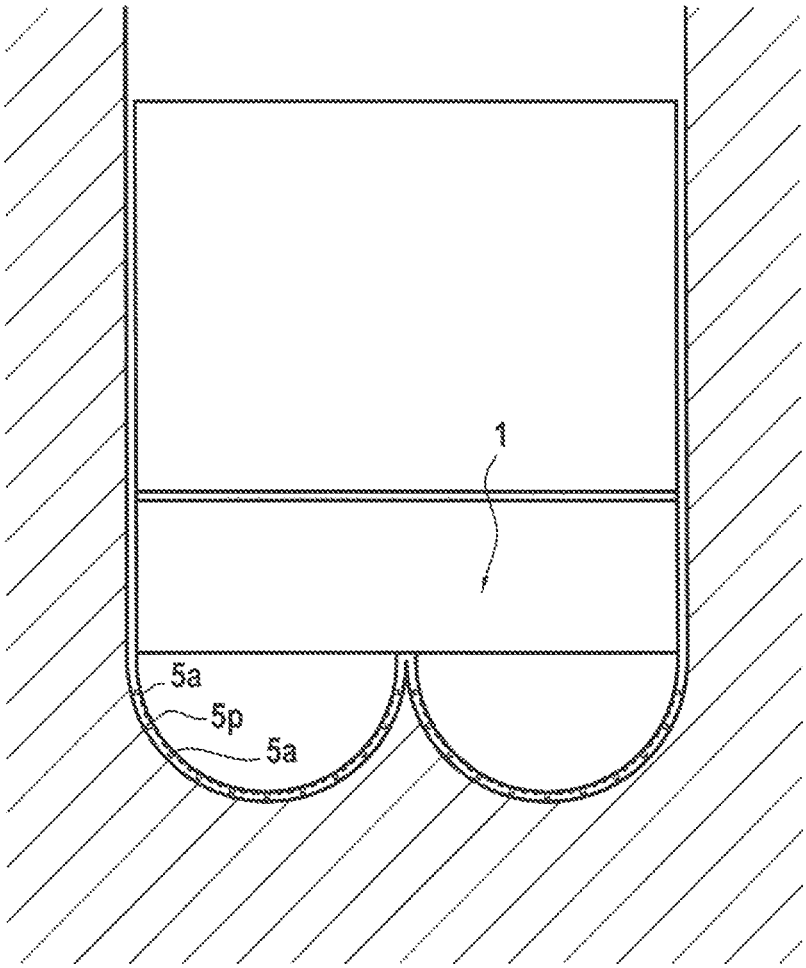
FIG. 4 shows another potential variant configuration for the electrodes.
Figure 5B:
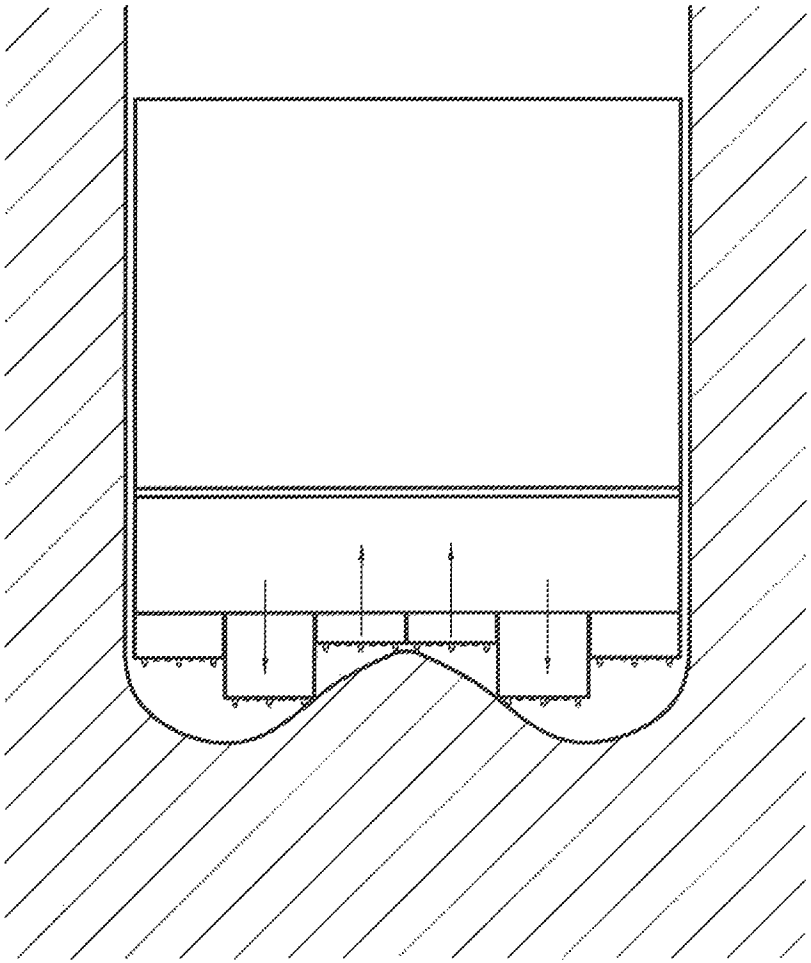
FIGS. 5A and 5B are diagrams showing a vertical movement of electrodes in a tool for excavation by electric pulses, in another variant.
Figure 5A:
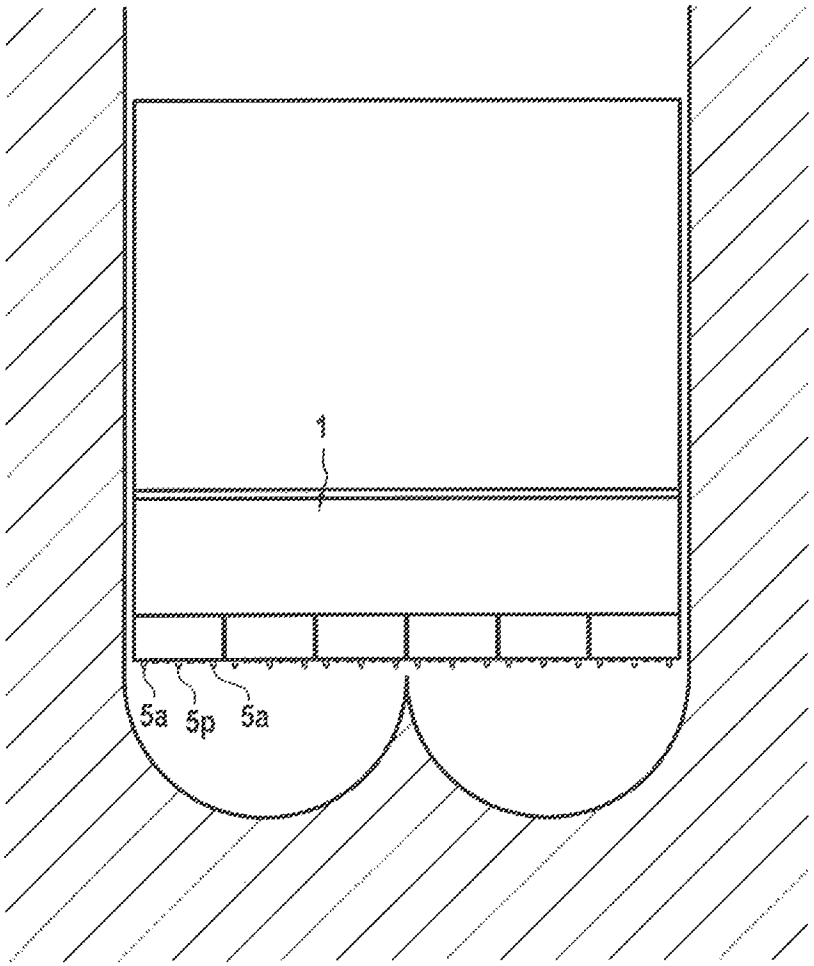

The electrodes 5*a*, 5*p* need not be arranged in the same horizontal plane, but they may be staged over a plurality of different heights, as shown in FIG. 4, in particular in order to match the excavation profile of the tool 1 to the excavation profile of a preceding tool. Furthermore, the electrodes 5*a*, 5*p* may move not only horizontally, but they may also move vertically, in addition to or as an alternative to moving horizontally. FIGS. 5A to 5B thus show another variant having a plurality of rows of electrodes 5*a*, 5*p* fitted with devices for driving vertical movement, serving to match the arrangement of the rows to a rock surface that is irregular. These devices for driving vertical and/or horizontal movements may in particular comprise linear actuators, specifically jacks and more particularly hydraulic jacks.

Furthermore, the electronic power module 4 may be configured to transmit the electric pulses to all of the active electrodes 5*a* either simultaneously, or else sequentially.

As shown in FIG. 2, the tool 1 for excavation by electric pulses also includes both an inlet 8 for removing spoil and that is connected to a spoil-removal passage 32, and also a fluid feed duct 6 leading to a plurality of fluid injection nozzles 7 that are distributed on the front face of the excavation tool. The fluid may be a liquid, such as for example drilling mud, or a gas, in particular compressed air, and it serves in particular to entrain spoil while it is being removed via the inlet 8 and the passage 32.

In operation, the rotary shaft of each electricity generator 3 is thus driven by the corresponding hydraulic motor 2 in order to generate electricity. The electronic power module 4 is thus electrically powered by the electricity generators 3 so as to generate the electric pulses that reduce discharges between the electrodes 5*a*, 5*p* in order to break up rocky material situated under the front face of the tool 1 for excavation by electric pulses. The fluid injected via the duct 6 and the nozzles 7 entrains the broken up rocky material while it is being removed through the inlet 8 and the passage 32 to the surface.

Figure 6:
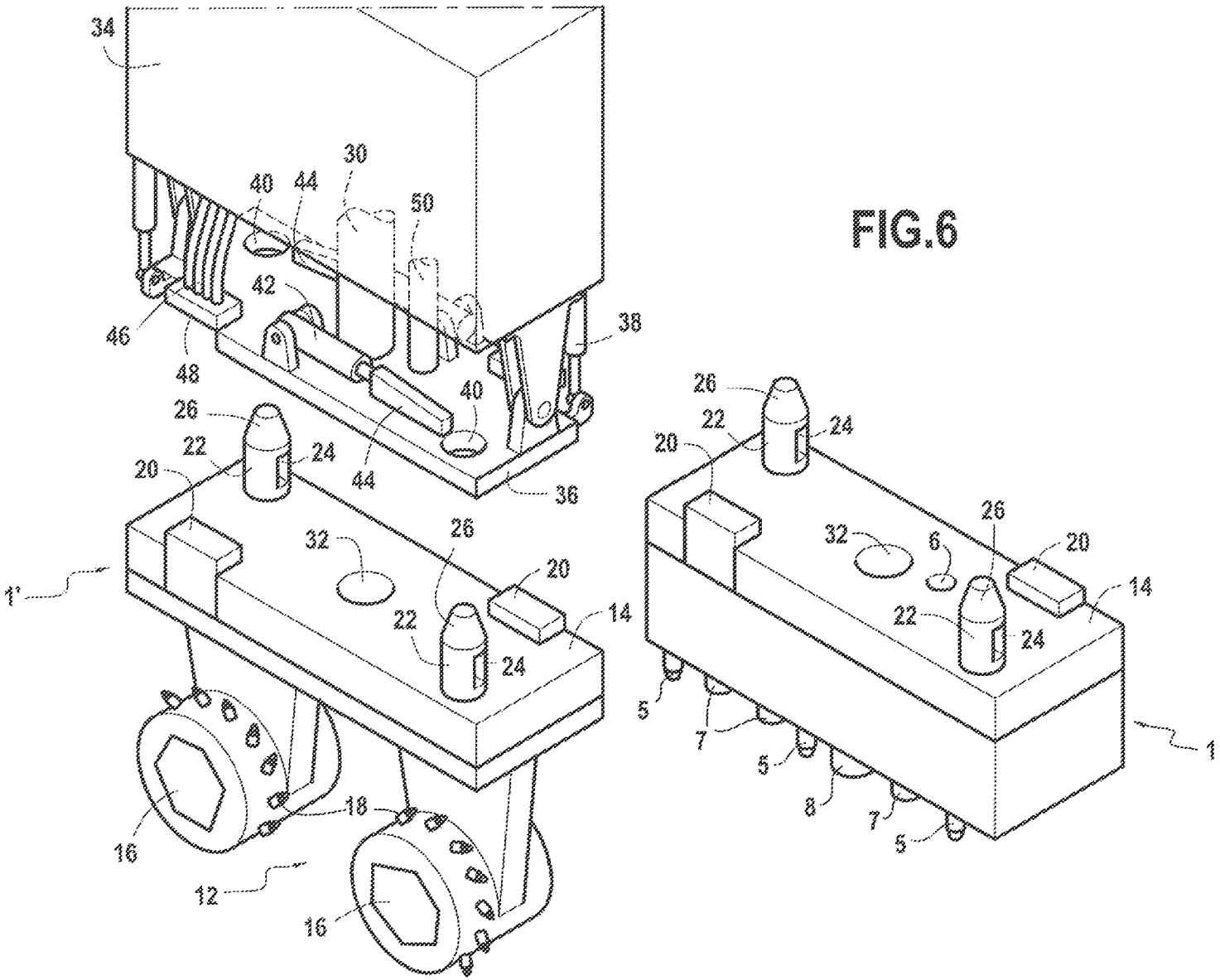
FIG. 6 is a detail view in perspective of the excavation system of FIGS. 1A and 1B, with a tool for excavation by electric pulses, a cutter type excavation tool, and a support frame adapted to receive one or the other.

FIG. 6 shows the tool 1 for excavation by electric pulses beside a bottom portion of the support frame 34, and the excavation tool 1' of the cutter type, which is configured to be mounted under the same support frame 34 so as to be interchangeable with the tool 1 for excavation by electric pulses. As can be seen in this figure, the tool for excavation by electric pulses may present a horizontal section, perpendicular to the excavation direction, that is substantially elongate, and more specifically rectangular, with a width L lying in the range 1 m to 4 m, for example, and more particularly of about 2.8 m, and a thickness E lying in the range 0.5 m to 1.8 m, and more particularly in the range 0.5 m to 1.5 m, for example.

As also shown in FIG. 6, the mechanical fastener members 22 in this embodiment are constituted by two pins in the form of cylindrical metal studs fastened rigidly to the interface 14 symmetrically about the center of the interface 14 and orthogonally relative thereto. Each mechanical fastener member 22 also includes an internal hole 24 that passes through it horizontally, and it has a top portion 26 that is conical in order to facilitate mounting, as described below.

At the bottom end of the frame 34 there is fastened a plate 36 that can be tilted relative to the frame, and it is substantially of the same dimensions as the interface 14 associated with the tool 1 for excavation by electric pulses. Tilting of the plate 36 is controlled by hydraulic actuators 38 fastened to said plate 36, thus forming a device for tilting the tool 1 for excavation by electric pulses about two horizontal axes when this excavation tool 1 is mounted under the plate 36.

A duct 30 of the spoil-removal circuit 150 is also fastened along the frame 34 in order to remove to the surface the broken up rocky material that is sucked in through the inlet 8 and the passage 32, and a duct 50 of the spoil-removal fluid feed circuit is also fastened thereto in order to feed the ducts 6 and the nozzles 7 with spoil-removal fluid. The bottom ends of these ducts 30, 50 pass through the plate 36. Furthermore, the frame 34 may also include both a spoil suction pump 151 arranged so as to be put into fluid flow communication with the spoil-removal inlet 8 via the passage 32 and the duct 30 when the excavation tool 1 is mounted under the plate 36, and also a hydraulic motor (not shown) connected to the hydraulic circuit of the excavation assembly 100 order to drive the spoil suction pump 151. Nevertheless, spoil suction devices with other drive means (e.g. electrical drive means) could equally well be envisaged.

The plate 36 associated with the frame 34 includes two cylindrical orifices 40 of diameter substantially equal to the diameter of the fastener members 22 fastened to the interface 14 associated with the cutter head 10. These holes 40 are arranged symmetrically about the center of the plate 36 so as to receive the studs 22 when the interface 14 for mounting the tool 1 for excavation by electric pulses is positioned under the plate 36.

Hydraulic jacks 42 are fastened on the top portion of the plate 36 associated with the frame 34 in the proximity of these holes 40. The ends of the rods of these jacks have respective metal wedges 44 fastened thereto of width that is substantially smaller than the width of the holes 24 in the above-mentioned studs 22 and of length extending along the axis XX'. The actuators 42 are positioned in such a manner as to enable the wedges 44 to be moved along the axes XX' so that in the actuated position, the wedges 44 lie exactly over the holes 24 in the plate 36. The fastening of the tool 1 for excavation by electric pulses can thus be released by using the hydraulic actuators 42. It can be understood that in this configuration, the relative configuration of the end of the frame 34, of the tool 1 for excavation by electric pulses, of the hydraulic fluid feed means, and of the removal means provides a device suitable for offering the same functions as a tool that cannot be taken apart. Nevertheless, removing the tool 1 for excavation by electric pulses as a whole enables the tool to be changed very quickly. Furthermore, in the embodiment described, this is done by actuating jacks, thereby greatly facilitating this operation.

The excavation tool 1' of the cutter type, which is also shown in FIG. 6, is compatible with the support frame 34, and is thus interchangeable with the tool 1 for excavation by electric pulses. For this purpose, it likewise has a mounting interface 14 with two mechanical fastener members 32 and a hydraulic coupling 20 of shape and dimensions equivalent to those of the tool 1 for excavation by electric pulses. Furthermore, this excavation tool 50 has a motor assembly 12 with two hydraulic motors (not shown) that are rigidly secured to the bottom portion of the mounting interface 14. Four cylindrical drums 16 constituted by cutter wheels are driven in rotation by the motors via mechanical connection means that are not shown. Cutter members 18, also known as cutter teeth, are rigidly fastened on the peripheries of the drums. The hydraulic motors are connected by hydraulic hoses to the hydraulic couplings 20 fastened to the top portion of the mounting interface 14 in symmetrical manner about the center of the mounting interface 14. These hydraulic hoses and couplings 20 thus also serve to deliver energy to the motor assembly 12 of the excavation tool 1'. Although, in the embodiment shown, the mechanical excavation tool is of the cutter type, it is equally possible to envisage that it is of some other type that includes a hydraulic actuator, e.g. a mechanical excavation tool with at least one bucket actuated by at least one hydraulic jack. The tool 1 for excavation by electric pulses and the cutter type excavation tool 1' can thus be interchanged quickly, depending on the layers of ground to be excavated, by disconnecting the mounting interface 14 of one of the two excavation tools 1, 1' from the support frame 34, and then connecting the mounting interface 14 of the other one of the excavation tools 1, 1' to the support frame 34.

Thus, it is possible to mount the tool 1 for excavation by electric pulses under the support frame 34 in order to excavate hard rocky layers, as shown in FIG. 1A, and then to replace it with the mechanical excavation tool 1' for excavating softer layers, as shown in FIG. 1B, and vice versa.

Although the present invention is described with reference to a specific embodiment, it is clear that various modifications and changes can be undertaken on those embodiments without going beyond the general ambit of the invention as defined by the claims. Consequently, the description and the drawings should be considered in a sense that is illustrative rather than restrictive.

The invention claimed is:

1. An excavation system comprising:

a support frame, a hydraulic circuit with a pump, and first and second excavation tools, one of the first and second excavation tools being a mechanical excavation tool having a hydraulic actuator and a mounting interface with at least one mechanical fastener member and at least one hydraulic coupling in fluid flow communication with said hydraulic actuator, and another of the first and second excavation tools being a tool for excavation by electric pulses, comprising:

an electricity generator with a rotary shaft for generating electricity from rotation of the rotary shaft, a hydraulic motor coupled to said rotary shaft to drive rotation of the rotary shaft, and an electronic power module electrically connected to the electricity generator in order to be powered by the electricity generator so as to generate electric pulses of instantaneous power that is higher than an instantaneous power of the electricity generator, a plurality of electrodes including at least one electrode connected to said electronic power module, the electrodes being arranged on a front face of the tool for excavation by electric pulses, and a mounting interface with at least one mechanical fastener member and at least one hydraulic coupling in fluid flow communication with the hydraulic motor, the mounting interface of the first excavation tool being suitable for releasably mounting the first excavation tool under the support frame of the excavation system, with the hydraulic coupling of the mounting interface of the first excavation tool in fluid flow communication with the hydraulic circuit of the excavation system, and the mounting interface of the second excavation tool being suitable for releasably mounting the second excavation tool, alternatively to the first excavation tool, under the support frame of the excavation system with the hydraulic coupling of the mounting interface of the second excavation tool in fluid flow communication with the hydraulic circuit of the excavation system.

2. The excavation system according to claim 1, wherein the support frame includes a device for tilting the excavation tool about at least one axis.

3. The excavation system according to claim 1, further including a spoil suction pump.

4. The excavation system according to claim 1, including a jib from which the support frame is suspended by at least one cable.

5. The excavation system according to claim 1, wherein the mechanical excavation tool is a cutter type excavation tool comprising a cutter member coupled to the hydraulic actuator of the mechanical excavation tool in order to be actuated.

6. The excavation system according to claim 1, wherein the plurality of electrodes comprises at least one row of a plurality of electrodes (5*a*, 5*p*) arranged at the periphery of said front face.

7. The excavation system according to claim 1, wherein the plurality of electrodes comprises at least one electrode arranged in a central zone of said front face.

8. The excavation system according to claim 1, wherein the plurality of electrodes comprises at least two electrodes connected to the electronic power module, and the electronic power module is configured to transmit electric pulses separately to each of the at least two electrodes to which the electronic power module is connected.

9. The excavation system according to claim 1, further comprising an actuator device for driving movement of at least one electrode of said plurality of electrodes, in particular with movement presenting at least a vertical component and/or a horizontal component.

10. The excavation system according to claim 9, wherein the actuator device comprises at least one linear actuator.

11. The excavation system according to claim 1, wherein the tool for excavation by electric pulses further includes at least one spoil-removal inlet.

12. The excavation system according to claim 1, wherein the tool for excavation by electric pulses further comprises a fluid feed duct leading to at least one fluid injection nozzle arranged on a front face of the excavation tool.

13. The excavation system according to claim 12, wherein the fluid feed duct leads to a plurality of fluid injection nozzles distributed over the front face of the excavation tool.

14. The excavation system according to claim 1, wherein said front face is elongate, e.g. rectangular, perpendicularly to an excavation direction.

15. A method of using an excavation system according to claim 1 for excavating a trench, the method comprising:

mounting the first excavation tool under the support frame;

excavating a first layer of ground with the first excavation tool;

replacing the first excavation tool under the support frame with the second excavation tool; and excavating a second layer of ground with the second excavation tool.

* * * * *